US006213831B1

(12) United States Patent
Smith

(10) Patent No.: US 6,213,831 B1
(45) Date of Patent: Apr. 10, 2001

(54) BODY HULL FOR BODY HULLING

(76) Inventor: Edmond R. Smith, N5601 County Rd. A, Green Lake, WI (US) 54941

( * ) Notice: Subject to any disclaimer, the term of this patent is extended or adjusted under 35 U.S.C. 154(b) by 0 days.

(21) Appl. No.: 09/668,535

(22) Filed: Sep. 25, 2000

(51) Int. Cl.[7] ..... B63B 1/00
(52) U.S. Cl. ..... 441/65
(58) Field of Search ..... 441/65, 74; 114/39.12, 114/39.11, 39.16, 39.18, 102.11; 244/155 A, 155 R

(56) References Cited

U.S. PATENT DOCUMENTS 1,510,532 * 10/1924 Zorn ..... 441/65
5,013,271 * 5/1991 Bartlett ..... 441/65
5,173,068 * 12/1992 Dunn et al. ..... 441/65
5,569,057 * 10/1996 Barsdorf et al. ..... 441/65

* cited by examiner

*Primary Examiner*—Ed Swinehart
(74) *Attorney, Agent, or Firm*—Donald Cayen

(57) ABSTRACT

A body hull is used in the new water sport of body hulling. The body hull comprises a front panel that extends approximately to the thigh of a person wearing it. The body hull further has a back panel and buckles for connecting the two panels under the person's arms. In one embodiment, the front panel is a relatively flat skiff-like hullform design, but it has a slightly convex shape centered along a longitudinal axis. The person wraps a tow harness behind his shoulders and under his arms and attaches the tow harness to the control bar or handles of a kite. When in the water, the person controls the kite to pull him across the water surface on the body hull front panel. For high winds, the outside surface of the front panel has a shallow vee or deep vee hullform centered along the longitudinal axis. The shallow or deep vee hullform enables the body hull front panel to smoothly penetrate the waves as the person hydroplanes across the water.

20 Claims, 6 Drawing Sheets

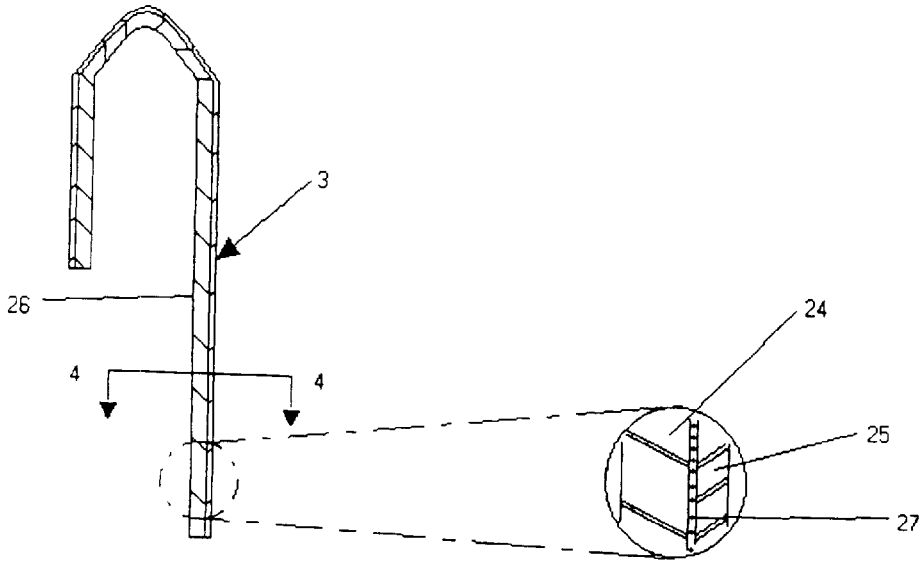
FIG. 3
FIG. 3A
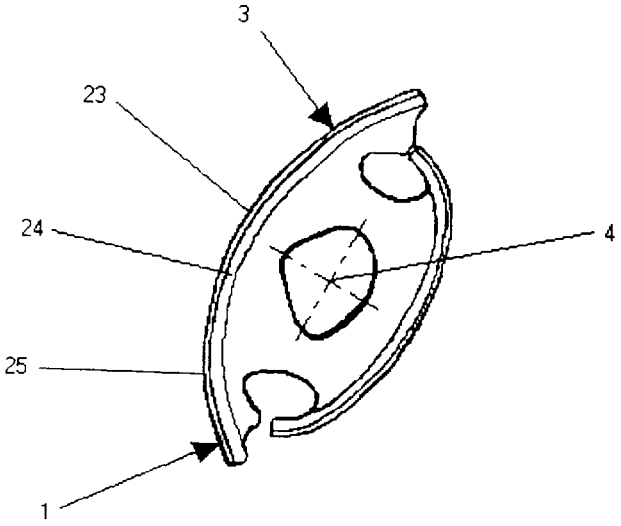
FIG. 4
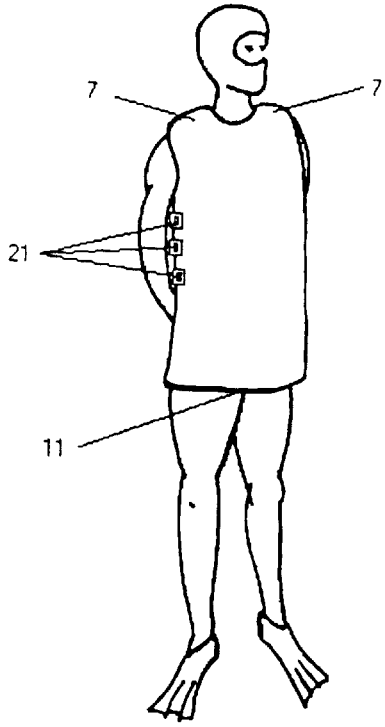
FIG. 5

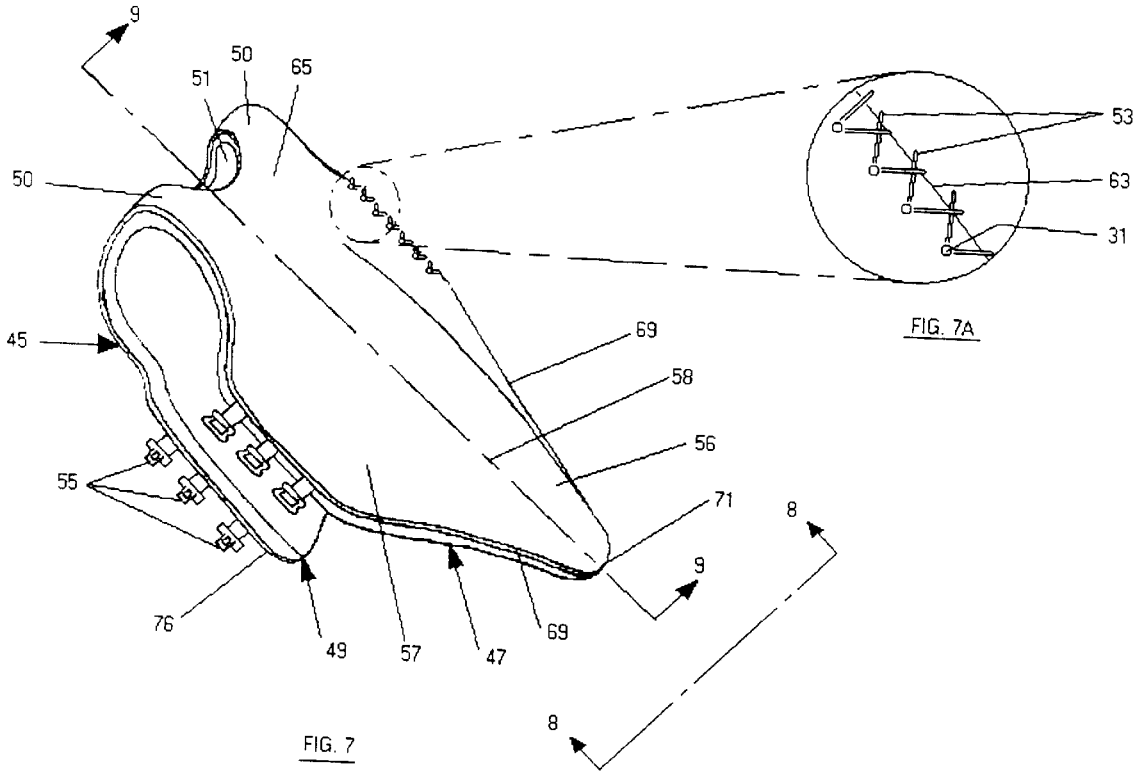
FIG. 7A
FIG. 7
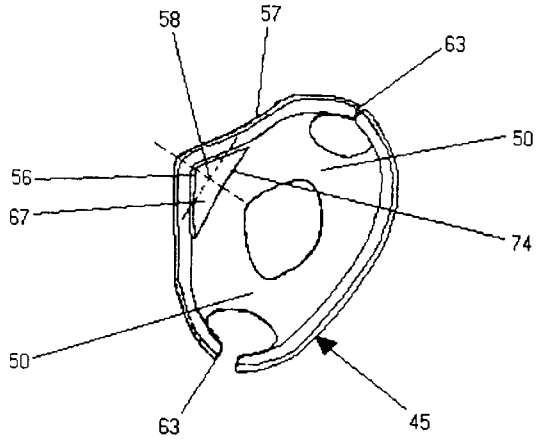
FIG. 8

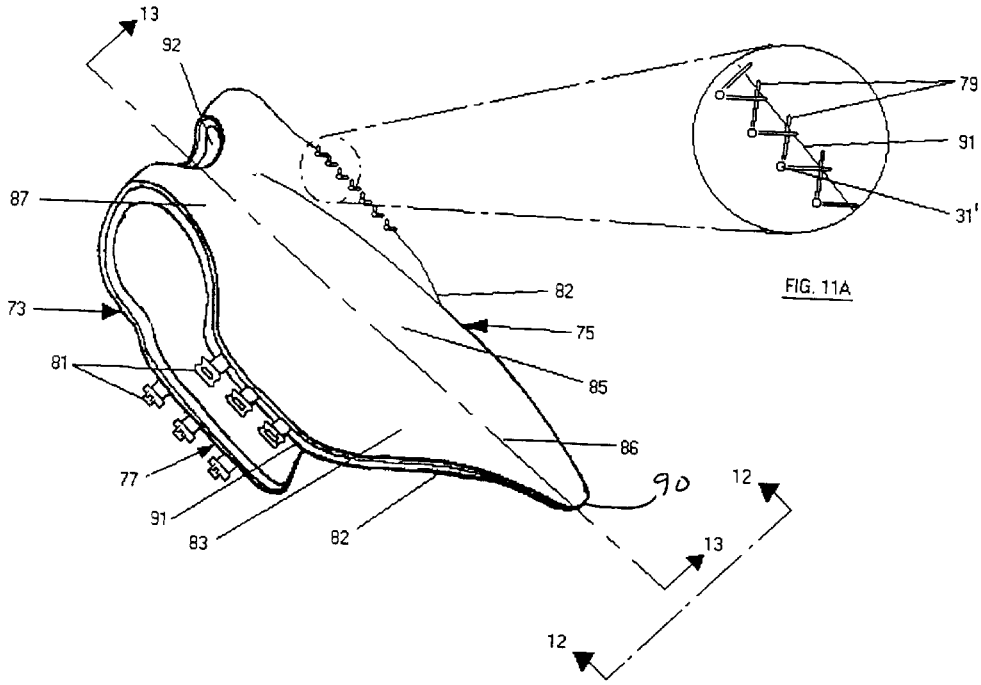
FIG. 11A
FIG. 11
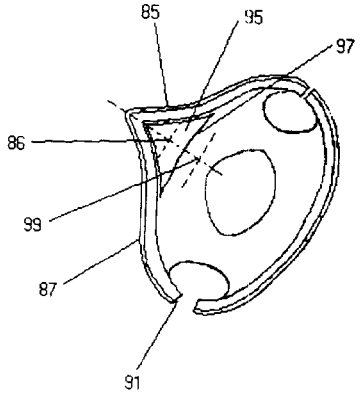
FIG. 12
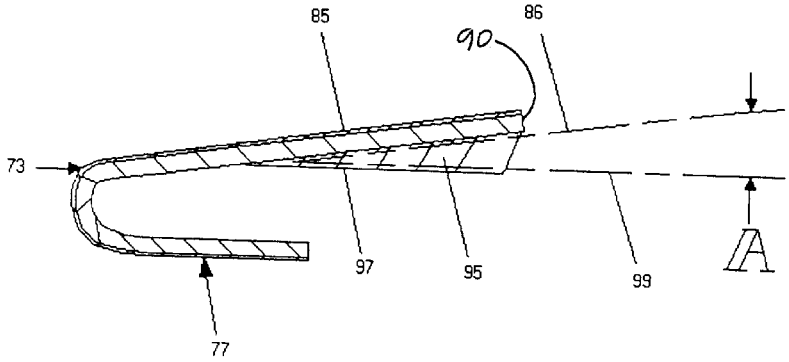
FIG. 13

BODY HULL FOR BODY HULLING

BACKGROUND OF THE INVENTION

1. Field of the Invention

This invention pertains to water sports, and more particularly to apparatus that enables a person to hydroplane across the water without using skis or a board.

2. Description of the Prior Art

Various types of equipment have been developed to enable people to use lakes and rivers for recreational purposes. For example, outboard and inboard motor boats are well known and in widespread use. Water skiing, in which a motor boat pulls a person wearing water skis, has been popular for a long time. Sailboats, canoes, and rowboats have also been used for pleasure for many years.

Recently, new types of water sports have become common. One example is sail boarding. In that sport, a person stands on a buoyant board, which supports a mast, boom, and sail. By maneuvering the mast and boom, the person can move across the water under wind power.

Another recent development in water sports is kite boarding. In that sport, a person stands on a buoyant board. He holds the power and control lines of an air foil or similar wing-like kite with his hands. The force of the wind on the kite is sufficient to pull the person across the water on the board.

Despite the thrills that can be obtained from sail boarding and kite boarding, they nevertheless have disadvantages. To kite board, for example, a person must be able to control both the kite and the board simultaneously. Gaining proficiency in that sport requires not only long hours of practice, but also great strength and athletic ability. Not all persons who would like to kite board are able to do so with reasonable proficiency. Nevertheless, those persons often desire to participate in a sport that combines the challenges of kite flying with the aesthetic appeal of moving across the water.

SUMMARY OF THE INVENTION

In accordance with the present invention, a new water sport of body hulling has been developed in which a person is pulled across the water without using mechanical power or boards. This is accomplished by apparatus that includes a sturdy body hull worn by the person, and a tow harness wrapped behind his body and connected to a kite.

The body hull preferably is made with semi-rigid flotation material. It has a front panel and a back panel, which are joined along shoulder regions that are separated by a head opening. The back panel extends to approximately the small of the person's back. The front panel is longer, extending to approximately the person's thighs. The inside surfaces of both panels are smooth and continuous, thereby presenting a comfortable fit to the person's torso. The panels are releasably connectable along their side edges, as by buckles, under the person's arms.

According to one aspect of the invention, the front panel is rectangular in shape. The panel outside surface has a skiff-like hullform that is smooth and generally flat. Preferably, the skiff-like hullform has a profile that is slightly convex about a longitudinal axis parallel to the front panel side edges.

To participate in the new water sport of body hulling, the person first releases the buckles. He puts the body hull over his head and then reconnects the buckles. The person places the tow harness behind his shoulders and under his arms.

The free ends of the tow harness are attached to the kite control bar or handles. The person launches the kite, controls it to remain at the neutral zone, and enters the water. By controlling the kite lines, the kite can develop enough force to pull the person across the water. At low speeds, the body hull front panel rides on the water surface. As the speed increases, the body hull front panel hydroplanes across the water. Hydroplaning is achieved efficiently even in light winds because of the large rectangular area of the front panel. Although the body hull is not intended or designed to be a life saving device, its flotation is more than adequate to assure that the person's head is always well above the water surface. The inherent upward angle of the pulling force produced by the kite lines on the kite bar or handles further contributes to keeping the person's head out of the water. Consequently, there is but minimal risk that the person will submerge when hydroplaning. Most of the pulling force developed by the kite is transferred through the tow harness to the person's shoulders. Consequently, his arms are not required to transmit the entire kite force to the rest of his body. His arms and hands are thus free to control the kite.

In a modified embodiment of the invention, the body hull front panel has a pentagon shape. Parallel portions of the front panel side edges extend from the shoulders to approximately the hips of the person wearing the body hull. Tapered portions of the side edges extend downwardly from the hips and intersect a short bottom edge that is approximately at the level of the person's thighs.

The outside surface of the modified front panel is generally flat along the parallel side edges and adjacent the shoulder regions and head opening. The outside surface has an elongated hullform resembling a shallow vee that is centered along the front panel longitudinal axis. The shallow vee hullform extends between the front panel bottom edge and the flat area adjacent the neck opening. The hullform blends smoothly along transition regions into the flat areas adjacent the parallel side edges. The hullform fills substantially the entire width of the front panel front surface between the tapered side edges. The inside surface of the front panel is generally parallel to the outside surface flat areas. That construction gives the inside surface a relatively flat and smooth surface for the comfort of the person wearing the body hull. The shallow vee hullform is particularly suited for winds that are stronger than those with which the body hull with the skiff-like hullform would be used. Tapering the front panel side edges removes surface area that is not needed to achieve hydroplaning with higher wind speeds.

For even stronger winds, another alternate body hull is used. The front panel of the high-wind body hull is pentagon in shape, having parallel side edges and tapered side edges that intersect a short bottom edge. The front panel outside surface has two relatively flat areas along the parallel side edges. The outside surface also has an elongated relatively deep vee hullform centered along a first longitudinal axis of the front panel. The deep vee hullform blends smoothly at transition regions into the front panel flat areas, but the hullform fills the front panel between the tapered side edges. The inside surface of the front panel is generally parallel to a second longitudinal axis that intersects the first longitudinal axis at a shallow angle. The inside surface is relatively flat and smooth so as to be comfortable to the person's chest and abdomen. The relatively deep vee hullform helps the front panel penetrate the waves that are invariably present on the water on windy days.

The method and apparatus of the invention, using a body hull with a smooth front panel, thus enables a person to hydroplane across the water in a thrilling manner in a new sport of body hulling. The force with which the kite pulls the person is applied mostly to his shoulders, thus leaving his hands free to control the kite.

Other advantages, benefits, and features of the present invention will become apparent to those skilled in the art upon reading the detailed description of the invention.

BRIEF DESCRIPTION OF THE DRAWINGS

FIG. 3 is a cross-sectional view taken along line 3— 3 of FIG. 2.

FIG. 3A is an enlargement of the cross-section of the body hull of FIG. 3.

FIG. 4 is a view taken along line 4—4 of FIG. 1.

FIG. 5 is a view of a person wearing the body hull of the invention.

FIG. 7 is a perspective view of the front of a modified embodiment of the invention.

FIG. 7A is an enlargement of the lacings used with the body hull of FIG. 7.

FIG. 8 is a view taken along line 8—8 of FIG. 7.

FIG. 11 is a perspective view of a further modified embodiment of the invention.

FIG. 11A is an enlargement of the lacings used with the body hull of FIG. 11.

FIG. 12 is a view taken along line 12—12 of FIG. 11.

FIG. 13 is a cross-sectional view taken along line 13—13 of FIG. 11.

DETAILED DESCRIPTION OF THE INVENTION

Figure 1:
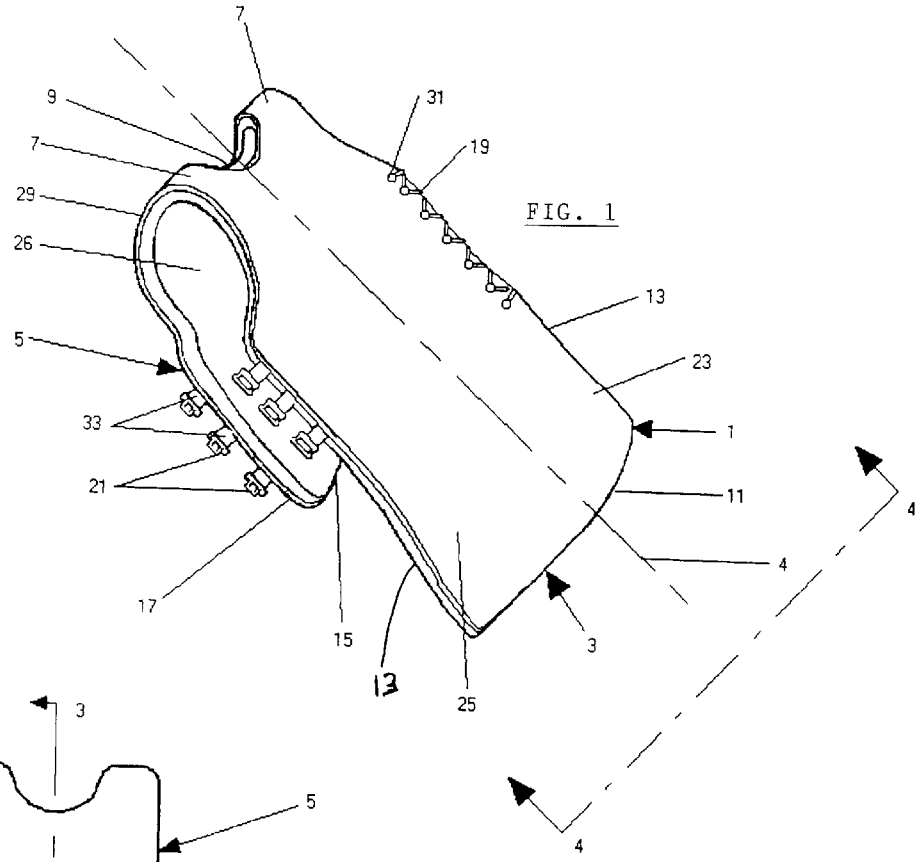
FIG. 1 a perspective view of the front of the body hull of the present invention.
Figure 2:
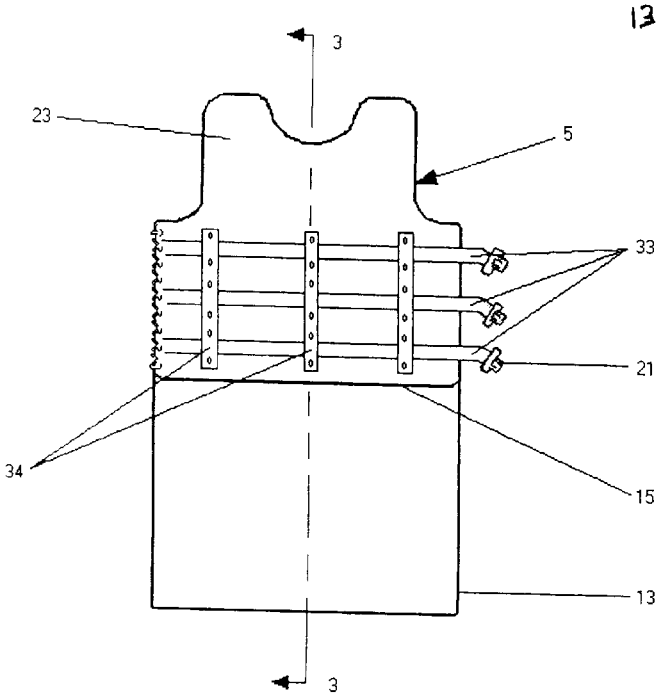
FIG. 2 is a back view of the body hull.

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Referring to FIGS. 1–4, a body hull 1 is illustrated that includes the present invention. The body hull 1 is particularly useful for participating in the new sport of body hulling, but it will be understood that the invention is not limited to non-traditional water related applications.

The body hull 1 is composed of a generally rectangular front panel 3 having a longitudinal axis 4 and a shorter back panel 5. Preferably, the front panel 3 is approximately 70 percent to 80 percent longer than the back panel 5. The front and back panels are permanently joined to each other in two shoulder regions 7. There is a head opening 9 between the shoulder regions 7. The front panel has a bottom edge 11 and generally parallel side edges 13. Similarly, the back panel has a bottom edge 15 and side edges 17. In the illustrated construction, lacings 19 connect one set of side edges 13 and 17 of the two panels. If desired, however, the front and back panels can be permanently and integrally joined along the side edges 13 and 17. Buckles 21 connect the opposite set of front and back panel side edges.

The body hull 1 has an outside surface 23 and an inside surface 26. The two surfaces 23 and 26 are generally parallel. As best seen in FIG. 4, the outside surface 23 of the front panel 3 is smooth and has a skiff-like hullform that is slightly convex about the longitudinal axis 4.

In the preferred embodiment, the body hull 1 is manufactured as a laminate of two sheets of two different materials. The first material is a one inch polyethylene foam flotation material 24. That material is semi-rigid, and it has excellent buoyant properties. It has relatively large air pockets, which give its outer surface a rather coarse contour. The second material is a conventional 0.25 inch dense polyethylene foam material 25. The one inch flotation material 24 is bonded to the 0.25 inch foam material 25 with a suitable adhesive 27, such as waterproof contact cement. The resulting laminate is cut out for the head opening 9. The side edges 17 are cut out slightly at arm regions 29 adjacent the shoulder regions 7. The laminate is folded over at the shoulder regions 7 such that the 0.25 inch dense polyethylene foam material 25 is the outside surface 23. The dense foam outside surface provides optional color to the body hull as well as a smooth outside surface. The shoulder regions are heated, as with forced hot air, to create a permanent set in the laminate. The semi-rigid characteristic of the one inch polyethylene foam gives shape and structure to the body hull. Holes 31 are produced in the front and back panels 3 and 5, respectively, for the lacings 19.

The buckles 21 are on the ends of associated straps 33. The straps 33 are sewn between the materials 24 and 25 in the front panel 3. The straps are not sewn to the back panel 5. Instead, they pass over the back panel outside surface 23 and are loosely captured in loops 34 that are sewn to the back panel outside surface. The result is a sturdy body hull having a relatively large rectangular shaped front panel, and the body hull can be adjusted to fit different size persons.

In one embodiment of the invention, the sheet of the one inch polyethylene foam flotation material 24 is approximately 60 inches long and 25 inches wide. The buoyancy of a sheet that size is rated at supporting approximately 200 pounds. The sheet of the 0.25 inch dense polyethylene foam material is approximately 62 inches long by 26 inches wide. That size compensates for the slightly curved shape of the body hull front panel and also allows a small overlap along the edges of the one inch polyethylene material. The distance of the head opening 9 from the back panel bottom edge 15 is approximately 22 inches. The front panel 3 is approximately 38 inches long.

To use the body hull 1, a person puts his head through the head opening 9, and rests the shoulder regions 7 on his shoulders, FIG. 5. The front panel bottom edge 11 then reaches to approximately mid-thigh of a person who is approximately six feet tall, and the back panel bottom edge 15 reaches to approximately the small of the person's back. The straps 33 are adjusted, and the buckles 21 are closed. The design of the straps 33 enables the back panel side edge 17 to underlap the front panel side edge 13 to suit a small person. The body hull is not designed or intended to be a life saving device. The person may therefore also want to wear a personal flotation device while body hulling.

Figure 6:
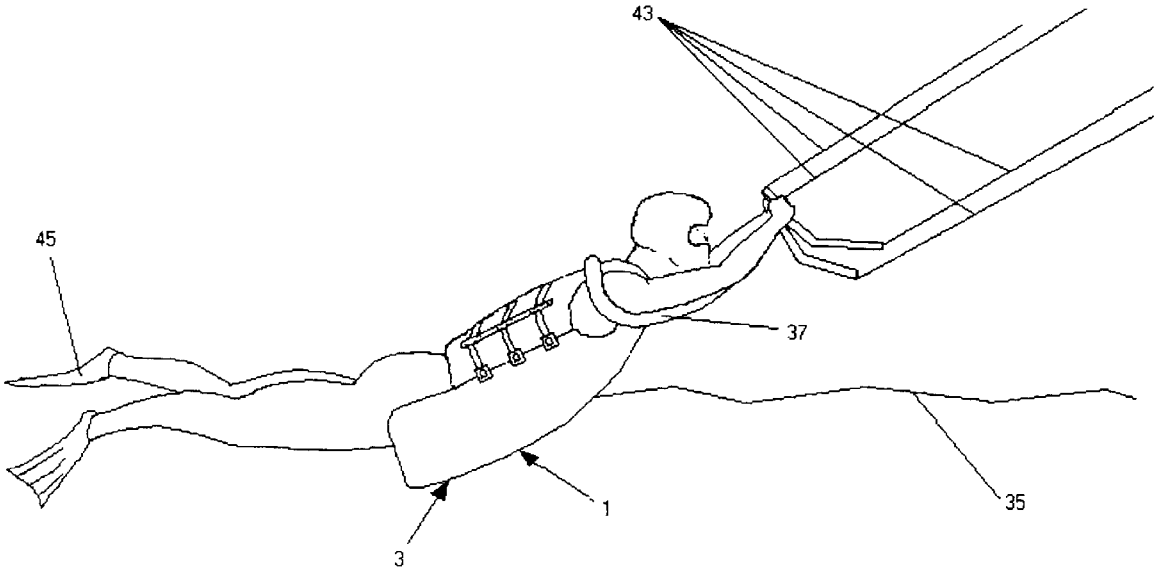
FIGS. 6 and 6A are views showing a person being propelled across the water wearing the body hull of the invention.
Figure 6A:
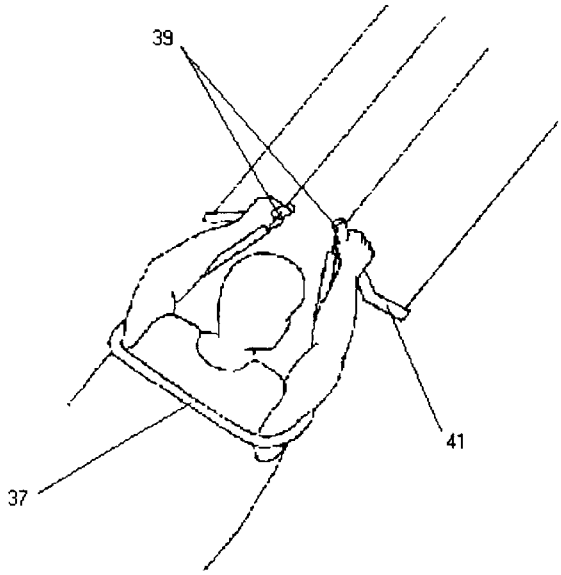

Looking at FIGS. 6 and 6A, the person loops a tow harness 37 under his arms and behind his shoulders. On the ends of the tow harness 37 are a pair of hooks 39. The person hooks the tow harness hooks 39 onto the control handles 41 of a conventional air foil kite, of which only the four control lines 43 are shown. If a two line control bar configuration is used, the harness hooks onto the control bar.

The person wearing the body hull 1 enters the water 35. If desired, he can wear flippers 45. If the water is so deep that he cannot stand, the body hull and personal flotation device will provide adequate flotation. When the person is ready, he controls the kite lines 43 to maneuver the kite into its power zone. When that happens, the kite develops enough force to pull the person head first across the water. The body hull front panel 3 provides a firm surface that supports and protects the person's body. The smooth skiff-like hullform with the rectangular front panel enables the body hull to start hydroplaning across the water at relatively low wind speeds. The buoyancy of the body hull and the personal flotation device is more than sufficient to produce adequate buoyancy at slow and sluggish speeds prior to hydroplaning speeds, and to assure that the person rides high on the water while hydroplaning. In addition, the vertical component of force exerted by the kite lines 43 on the handles 41 assures that the person's head is always well above the water surface. Approximately 80 percent of the kite force is transmitted to the person through the tow harness 37. Consequently, the person's arms and hands are needed primarily only to control the kite through the handles and lines 43. By controlling the kite, the person can vary his speed across the water from a maximum to a stopped condition. Directional control of as much as approximately 40 degrees left or right of the downwind direction is also achievable by manipulating the kite control lines.

Figure 9:
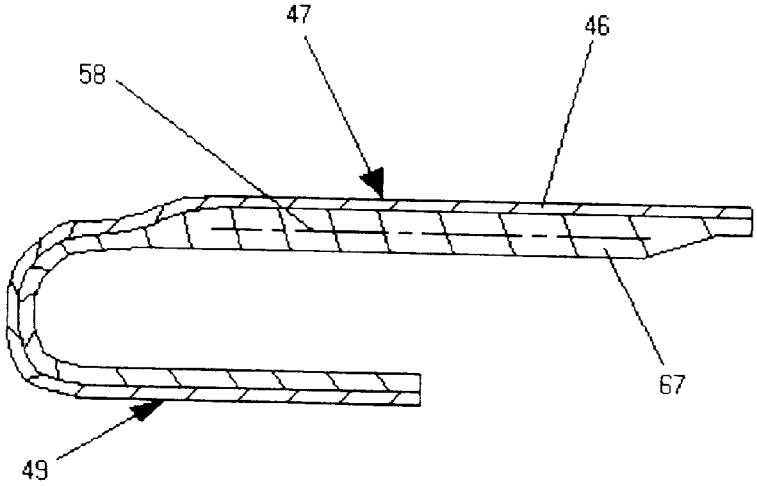
FIG. 9 is a cross-sectional view taken along line 9—9 of FIG. 7.

The body hull 1 is ideal for body hulling when the wind speed is approximately ten knots or less. For higher wind speeds, waves usually develop on the water 35. To enable the body hull to smoothly hydroplane and penetrate the waves, a modified design is provided. Looking at FIGS. 7–9, a modified body hull 45 is made from a laminate of one inch polyethylene foam flotation material 67 and 0.25 inch dense polyethylene foam material 46. The body hull 45 has a front panel 47 and a back panel 49 connected by shoulder regions 50, a head opening 51, lacings 53, and buckles 55. The front panel 47 has parallel side edges 63 and two tapered side edges 69 that converge and intersect a short bottom edge 71. The front panel outside surface 57 has an elongated rather shallow vee hullform 56 centered along a front panel longitudinal axis 58. The shallow vee hullform 56 blends to the side edges 63 and the tapered side edges 69. The hullform 56 need not extend all the way to the head opening 51. Instead, it is sufficient that the hullform blend into a flat area 65 adjacent the head opening 51. To help retain the shape of the hullform 56, as well as to provide comfort to the chest and abdomen of the person, extra flotation material 67 is used under the hullform. The extra flotation material 67 is shaped to make a smooth and continuous inner surface 74 that is generally parallel to the longitudinal axis 58.

Figure 10:
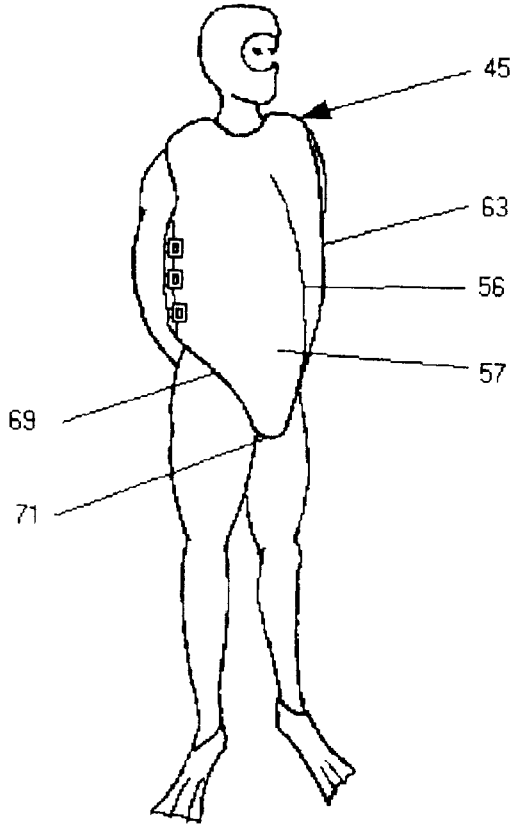
FIG. 10 is a view showing a person wearing the modified body hull of FIGS. 7–9.

When the shallow vee hullform body vest 45 is worn, FIG. 10, the front panel bottom edge 71 is approximately at mid-thigh of the person. The junctions of the parallel side edges 63 and the associated tapered edges 69 are approximately at the hips of the person.

The shallow vee hullform body hull 45 is used in substantially the same way as the skiff-like hullform body hull 1 described previously with regard to FIGS. 1–6. The body hull 45 works very well for wind speeds between approximately ten and 15 knots. The shallow vee hullform 56 on the outside surface 57 enables the body hull to penetrate and hydroplane across small waves. Any shocks to the person's body from hitting waves with the body hull are thus reduced and even eliminated.

For wind speeds greater than approximately 15 knots, a further modified body hull 73 is used, FIGS. 11–13. The body hull 73 has a front panel 75 with a bottom edge 90, a back panel 77, holes 31' for lacings 79, and buckles 81. The front panel 75 has tapered side edges 82 between parallel side edges 91 and the bottom edge 90. The front panel outside surface 83 has an elongated rather sharp deep vee hullform 85 centered along a first longitudinal axis 86. The deep vee hullform 85 blends smoothly through reverse curve transition regions 87 to the parallel side edges 91 and to the tapered side edges 82. The hullform 85 extends from the bottom edge 90 of the front panel to a head opening 92 opposite the bottom edge.

To provide comfort to the person using the deep vee hullform body hull 73, extra one inch foam flotation material 95 is provided under the hullform 85 to make a smooth and continuous inside surface 97. As best seen in FIG. 13, the inside surface 97 is generally parallel to a second longitudinal axis 99 that is between the first longitudinal axis 86 and the back panel 77. The longitudinal axes 86 and 99 intersect at an angle A. A satisfactory value angle A is between approximately 10 degrees and 20 degrees. In addition to providing comfort to the person wearing the body hull 73, the extra flotation material 95 helps to maintain the shape of the hullform 85.

The body hull 73 is used in substantially the same way as the skiff-like hullform body hull 1 and the shallow vee hullform body hull 45 described previously. The deep vee hullform 85 penetrates the relatively large waves that are usually present with winds greater than approximately 15 knots. The body hulling sportsman thus enjoys a smoother ride than if the skiff-like or shallow vee hullforms were used on the body hull.

In summary, the recreational opportunities available from small and large bodies of water can now be more fully realized. The body hull provides a person with both the ability to participate in the new water sport of body hulling as well as relative comfort as he is pulled by a kite across the water 35. This desirable result comes from using the combined functions of the body hull front panel hullforms. The front panel provides a firm and smooth surface that is in contact with the water. The front panel also provides protection for the person's chest and abdomen. The body hull is comfortable to wear, and it provides considerable flotation to the person. The front panel can be made in different configurations to suit the wind speed and wave action. The relatively large surface area of the rectangular skiff-like hullform of the body hull 1 is satisfactory for light winds. For increased wind speeds, the front panel outside surface is made with an elongated shallow vee or deep vee hullform to better penetrate the waves and cushion the shocks as the person hydroplanes across the water. The tow harness 37 transmits most of the pulling force from the kite to the person's shoulders. His arms and hands are therefore free to control the kite without having to also bear the pulling force.

It will also be recognized that in addition to the superior performance of the invention, its cost is nominal in relation to the benefits it provides. Also, because it is made of a simple design and with rugged components, it gives long service life with minimal upkeep.

Thus, it is apparent that there has been provided, in accordance with the invention, a body hull for body hulling that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A body hull comprising:

a. a sheet of material having side edges, a predetermined length, and a predetermined width, the sheet being folded over along a fold line to form a front panel and a back panel each having inside and outside surfaces and side edges and a bottom edge with the front panel being approximately 70 percent to 80 percent longer than the back panel, the sheet defining a head opening therethrough on the fold line and approximately midway between the side edges thereof; and b. means for releasably connecting at least one side edge of the front panel to at least one side edge of the back panel, so that the body hull is wearable on a person by putting the head opening over the head of the person with the fold line resting on the shoulders of the person and with the front panel being in the front of the person and the back panel being in the back of the person, and with the means for releasably connecting said at least one side edge of the front and back panels being under the arms of the person.

2. The body hull of claim 1 wherein:

a. the sheet is made from a sheet of 0.25 inch dense polyethylene foam material bonded to a sheet of one inch semi-rigid polyethylene foam flotation material; and b. the sheet is folded such that the 0.25 inch dense polyethylene foam material is the outside surface of the front and back panels.

3. The body hull of claim 2 wherein the front panel is approximately 38 inches long, and wherein the back panel is approximately 22 inches long.

4. The body hull of claim 1 wherein:

a. the front panel defines a longitudinal axis generally parallel to the front panel side edges; and b. the front panel outside surface is convex about the longitudinal axis.

5. The body hull of claim 1 wherein the front panel has a generally pentagon shape with parallel side edges, and tapered side edges that intersect a bottom edge, the front panel defining a longitudinal axis generally parallel to the parallel side edges, the front panel having a generally flat area adjacent the head opening, the front panel outside surface having an elongated shallow vee hullform centered along the longitudinal axis and extending generally between the parallel side edges and between the bottom edge and the flat area adjacent the neck opening.

6. The body hull of claim 1 wherein:

a. the front panel has a generally pentagon shape with parallel side edges and tapered side edges that intersect a bottom edge, the front panel defining a first longitudinal axis generally parallel to the parallel side edges; and b. the front panel outside surface defines a vee-shaped hullform centered along the first longitudinal axis.

7. The body hull of claim 6 wherein:

a. the laminate is made from a sheet of 0.25 inch dense polyethylene foam material bonded to a sheet of one inch semi-rigid polyethylene foam flotation material;

b. the sheet is folded such that the sheet of 0.25 inch dense polyethylene foam material is the outside surface of the front and back panels; and c. extra material of the one inch semi-rigid polyethylene foam flotation material is added to the front panel inside surface such that the front panel inside surface is generally parallel to a second longitudinal axis that is between the first longitudinal axis and the back panel, the first and second longitudinal axes diverging in the direction of the front panel bottom edge and intersecting at a predetermined angle.

8. The body hull of claim 7 wherein the predetermined angle is between approximately 10 degrees and 20 degrees.

9. The body hull of claim 6 wherein the front panel inside surface is smooth and continuous under the hullform on the outside surface.

10. Apparatus wearable by a person participating in the sport of body hulling comprising:

a. a front panel that extends from the shoulders of the person to approximately the thighs of the person;

b. a back panel that extends from the shoulders of the person to approximately the small of the back of the person;

c. shoulder regions joining the front and back panels and overlying the shoulders of the person with a neck opening therebetween; and d. means for releasably connecting the front and back panels under at least one arm of the person, so that a person pulled across a water surface is supported by and rides on the front panel.

11. The apparatus of claim 10 wherein the front panel defines a longitudinal axis, and wherein the front panel has a generally flat skiff-like outside surface that is convex about the longitudinal axis.

12. The apparatus of claim 10 wherein the front and back panels are each made of a laminate of a first selected foam material having a relatively course contour, and a second selected foam material having a relatively smooth contour.

13. The apparatus of claim 12 wherein the second selected material forms an outside surface of the front and back panels.

14. The apparatus of claim 10 wherein:

a. the front panel has tapered side edges that intersect a bottom edge, and the front panel defines a longitudinal axis parallel to the side edges;

b. the front panel has an outside surface with a generally flat area adjacent the shoulder regions; and c. the front panel outside surface has an elongated vee-shaped hullform centered along the longitudinal axis and located between the bottom edge and the flat area adjacent the shoulder regions.

15. The apparatus of claim 14 wherein the front panel has an inside surface that is smooth and continuous under the outside surface hullform to make a comfortable smooth surface for the chest and abdomen when worn by a person.

16. The apparatus of claim 10 wherein:

a. the front panel has inside and outside surfaces and parallel side edges and tapered side edges that intersect a bottom edge, the front panel defines a first longitudinal axis parallel to the side edges;

b. the front panel further defines a second longitudinal axis that intersects the first longitudinal axis at a predetermined angle, the first longitudinal axis being between the second longitudinal axis and the back panel; and c. the front panel outside surface has an elongated deep vee hullform between the bottom edge and the neck opening, the deep vee hullform being centered along the second longitudinal axis.

17. The apparatus of claim 15 wherein the front panel inside surface is parallel to the second longitudinal axis.

18. A method of participating in a water sport comprising the steps of:

a. wearing a body hull having a front panel with parallel side edges and a bottom edge that is approximately at the thigh of a person wearing the body hull, and a back panel that extends to approximately the small of the back of the person;

b. wrapping a tow harness behind the shoulders and under the arms of the person;

c. hooking the tow harness to a kite; and d. controlling the kite and pulling the person across a water surface, the person riding across the water surface on the body hull front panel.

19. The method of claim 18 wherein the step of wearing a body hull comprises the step of providing the body hull with a front panel that defines a longitudinal axis and that has an outside surface that is convex about the longitudinal axis.

20. The method of claim 18 wherein the step of wearing a body hull comprises the step of providing the body hull with tapered side edges between the parallel side edges and the bottom edge and with an elongated vee shaped hullform centered along a longitudinal axis of the front panel.

* * * * *